US009615707B2

(12) United States Patent
Stein et al.

(10) Patent No.: US 9,615,707 B2
(45) Date of Patent: Apr. 11, 2017

(54) FLOOR CARE APPLIANCE

(71) Applicant: Stein & Co. GmbH, Velbert (DE)

(72) Inventors: Thomas Stein, Velbert (DE); Achim Liffers, Velbert (DE)

(73) Assignee: STEIN & CO. GmbH, Velbert (DE)

( * ) Notice: Subject to any disclaimer, the term of this patent is extended or adjusted under 35 U.S.C. 154(b) by 87 days.

(21) Appl. No.: 14/704,028

(22) Filed: May 5, 2015

(65) Prior Publication Data

US 2015/0313430 A1 Nov. 5, 2015

(30) Foreign Application Priority Data

May 5, 2014 (DE) ..... 10 2014 006 981
Jun. 6, 2014 (DE) ..... 10 2014 008 457

(51) Int. Cl.

| | |
|---|---|
| ***A47L 5/00*** | (2006.01) |
| ***A47L 9/04*** | (2006.01) |
| ***A47L 9/00*** | (2006.01) |
| ***A47L 5/30*** | (2006.01) |
| ***A47L 5/32*** | (2006.01) |
| ***A47L 5/34*** | (2006.01) |

(52) U.S. Cl.

CPC ..... *A47L 9/0411* (2013.01); *A47L 5/30* (2013.01); *A47L 5/32* (2013.01); *A47L 5/34* (2013.01); *A47L 9/009* (2013.01); *A47L 9/0477* (2013.01); *A47L 9/0494* (2013.01)

(58) Field of Classification Search

CPC ..... A47L 5/34; A47L 5/32; A47L 5/30; A47L 9/009; A47L 9/0411; A47L 9/0494; A47L 9/0477

IPC ..... A47L 5/00

See application file for complete search history.

(56) References Cited

U.S. PATENT DOCUMENTS

| | | | | | |
|---|---|---|---|---|---|
| 2,146,602 | A | * | 2/1939 | Spooner, Jr. | A47L 5/34 15/339 |
| 2,334,364 | A | * | 11/1943 | Vavrik | A47L 11/4058 15/354 |
| 2,734,217 | A | | 2/1956 | Brace | |
| 2,741,488 | A | * | 4/1956 | Ripple | A47L 5/34 15/339 |
| 3,654,661 | A | * | 4/1972 | Scott | A47L 5/34 15/333 |
| 3,909,874 | A | * | 10/1975 | Clowers | A47L 5/34 15/339 |
| 4,437,205 | A | * | 3/1984 | Koland | A47L 5/34 15/354 |
| 4,614,003 | A | * | 9/1986 | Martin | A47L 5/34 15/339 |
| 5,974,625 | A | * | 11/1999 | Garner | A47L 5/28 15/333 |
| 2007/0020914 | A1 | | 1/2007 | Higashi | |

(Continued)

OTHER PUBLICATIONS

German Search Report, Jun. 6, 2014.

EP Search Report for corresponding EP patent application No. 15 16 6365, dated Sep. 8, 2015.

*Primary Examiner* — David Redding

(74) *Attorney, Agent, or Firm* — Greer Burns & Crain, Ltd.

(57) ABSTRACT

A floor care appliance having a height-adjustable brush set. A pushbutton of the brush set is actuatable for height adjustment via a manual suction tube of the floor care appliance. The pushbutton has a receptacle for receiving an edge region of a manual suction tube and/or for foot actuation.

6 Claims, 3 Drawing Sheets

(56) References Cited

U.S. PATENT DOCUMENTS

| | | | | |
|---|---|---|---|---|
| 2007/0209144 | A1 | 9/2007 | Fester et al. | |
| 2008/0072398 | A1* | 3/2008 | Moon | A47L 5/34 15/354 |
| 2009/0044374 | A1 | 2/2009 | Ni | |
| 2012/0131764 | A1* | 5/2012 | Miner | A47L 5/225 15/354 |

* cited by examiner

FLOOR CARE APPLIANCE

CROSS-REFERENCES TO RELATED APPLICATIONS

This application claims the benefit of the German patent application No. 10 2014 008 457.4 filed on Jun. 6, 2014, and of the German patent application No. 10 2014 006 981.8 filed on May 5, 2014, the entire disclosures of which are incorporated herein by way of reference.

BACKGROUND OF THE INVENTION

The invention relates to a floor care appliance in the form of a brush vacuum cleaner comprising a brush set facing the floor with a driven brush roller and a suction fan, where a filter housing is connected to a handle by means of a pivotable connecting element, where an electric suction fan guides the dirt-laden air via a riser into an upper region of the filter housing and the riser with a rigid manual suction tube for auxiliary suction work is disposed detachably on the filter housing, where the brush set has wheels and where at least one wheel is arranged height-adjustably for adjustment of the brush roller with respect to the floor for adaptation of the brush roller to the present work conditions.

It is known in arrangements of this type to make a height adjustment for the brush roller in various ways, in order to make an adaptation of the brush roller to the present work conditions such as underfloor conditions and brush wear. Electric/electronic adjusting devices are substantially known in order to make the adjustment of the brush roller and ensure uniform tracking forces of the brush roller regardless of the underfloor. The known configurations are relatively expensive and sensitive. Furthermore it is known to set the brush roller at a distance from the floor by manual settings of a wheel. Here it is found that the settings are not made in practice on account of the handling since the accessibility is not user-friendly or operation can only be carried out on the floor. Documentary prior art is disclosed in US 2007 0 209 144 A1 and in U.S. Pat. No. 2,734,217 A.

SUMMARY OF THE INVENTION

It is an object of the invention to provide an improvement of mechanical adjusting devices for brush rollers of generic floor care appliances which enable a user-friendly height adjustment of the brush roller.

This object is solved according to the invention whereby the height-adjustable wheel in the brush set is coupled by means of a pushbutton in the upper housing region of the brush set onto a multistage switchable detent of a switching over mechanism for height adjustment of the wheel via an adjustable adjusting axis and that the detachable manual suction tube of the filter housing serves as actuating element of a control surface of the pushbutton on the brush set, where the control surface of the pushbutton has a receptacle for the corresponding receipt of an edge region of the manual suction tube.

This makes it possible that the height adjustment can be executed in the upper housing region of the brush set by the detachable manual suction tube from the level of the operator.

In order to improve the actuation, it is provided in one exemplary embodiment that the control surface of the pushbutton has a gap or recess as receptacle for the corresponding receipt of an edge region of the manual suction tube. The gap thus creates a lateral contact surface for the manual suction tube which enables a secure operative connection between the manual suction tube and the pressure switch during pressure actuation and prevents the manual suction tube from slipping away during pressure actuation.

In an alternative exemplary embodiment it is provided that the control surface of the pushbutton has an elevation as receptacle for the corresponding receipt of an edge region of the manual suction tube. The elevation can, for example, be a web, a rib, at least one pin and the like. Consequently, similarly to the recess, the elevation creates a lateral contact surface for the manual suction tube which enables a secure operative connection between the manual suction tube and the pressure switch during pressure actuation and prevents the manual suction tube from slipping away during pressure actuation.

In addition, the control surface can have an actuating section for foot actuation or the receptacle can be configured in such a manner that a foot actuation is ensured. As a result of the foot actuation, a height adjustment can also be carried out from the level of the operator.

An advantageous arrangement consists in that the pushbutton is disposed in the edge region of the housing of the brush set.

In order to document the actual height adjustment, it is provided that the multistage switchable detent is connected to a rotating element for position display, which can be displayed via a viewing window in the brush set as set height adjustment of the wheel.

BRIEF DESCRIPTION OF THE DRAWINGS

An exemplary embodiment of the invention is shown schematically in the drawings. In the figures.

DETAILED DESCRIPTION OF THE PREFERRED EMBODIMENTS

Figure 1:
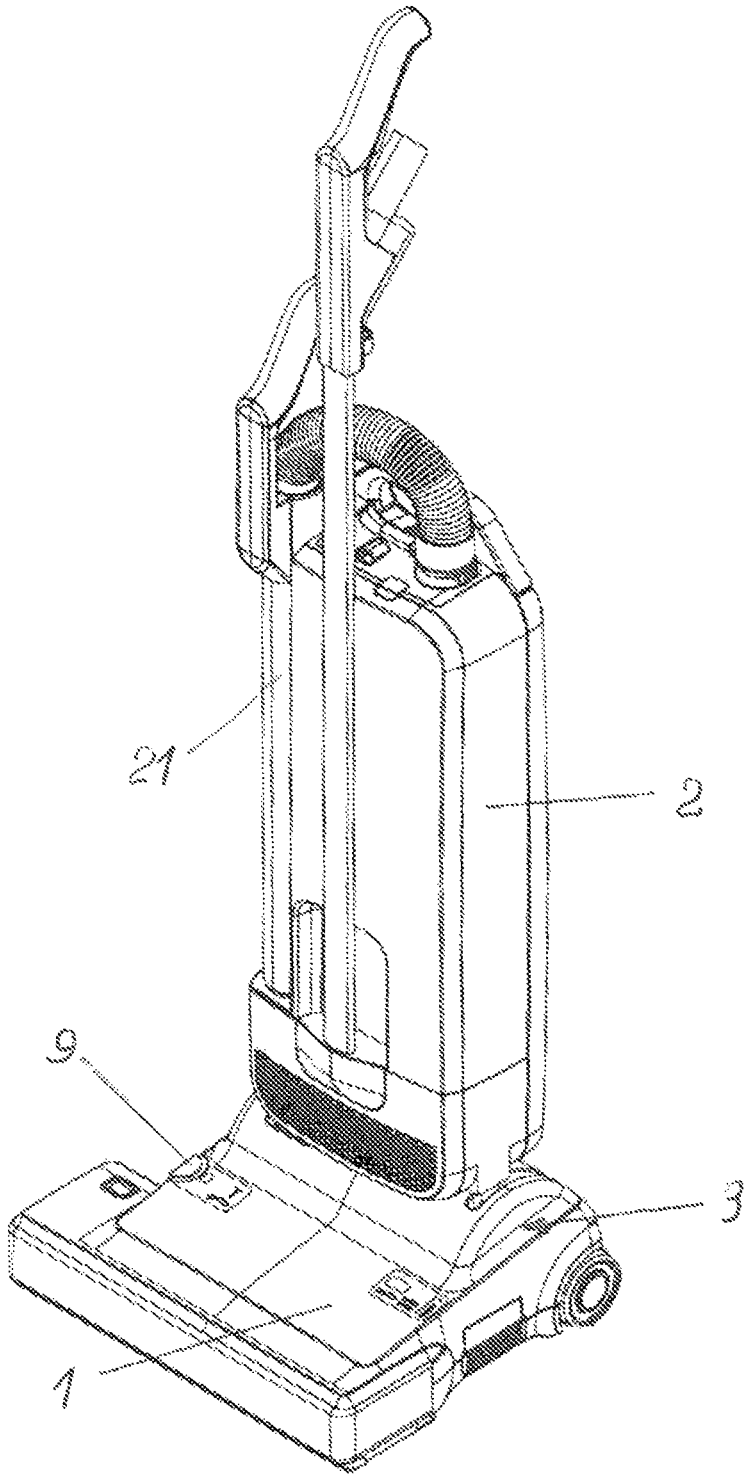
FIG. 1 shows a brush vacuum cleaner with a brush set and a filter housing placed thereon with a detachable rigid manual suction tube.
Figure 2:
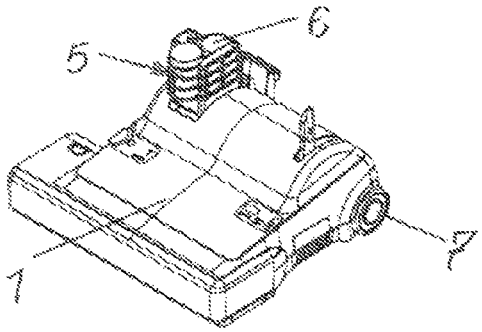
FIG. 2 shows a brush set of the brush vacuum cleaner.
Figure 3:
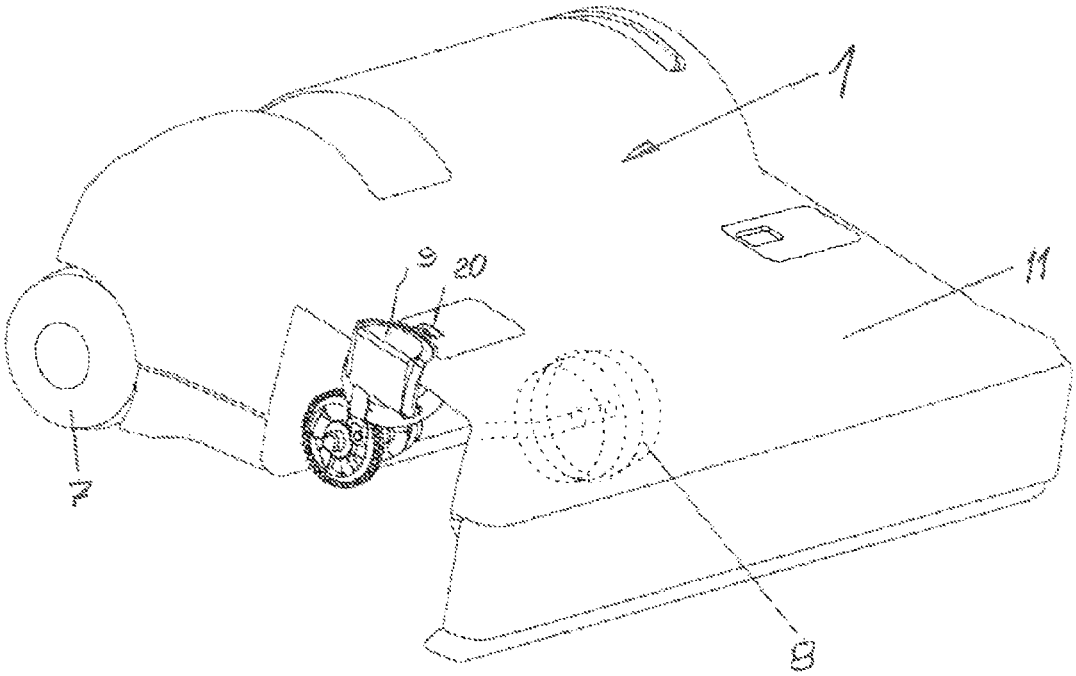
FIG. 3 shows a schematic view of a switching-over mechanism for height adjustment of a wheel.
Figure 4:
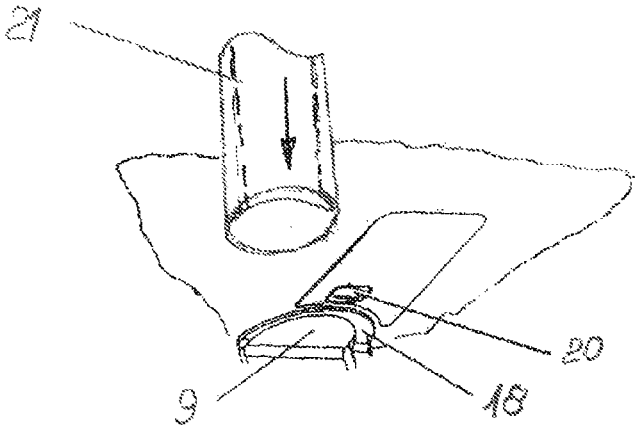
FIG. 4 shows an assignment of manual suction tube to be placed thereon and pushbutton and FIG. 5 shows a side view according to FIG. 3.
Figure 5:
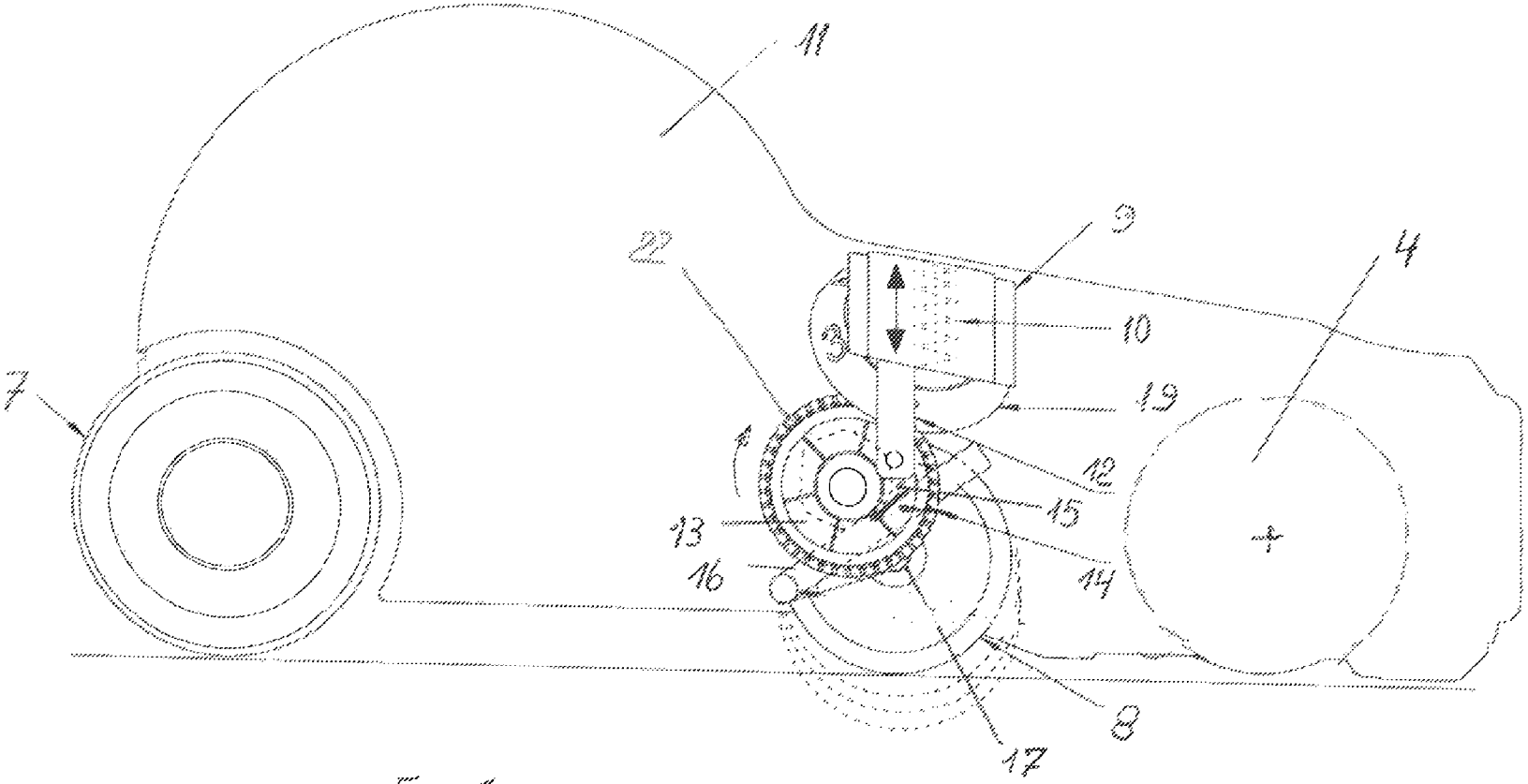

The brush vacuum cleaner shown comprises a brush set 1 and an attachable filter housing 2 with a handle, where the brush set 1 comprises in a known manner a motor 3 for a suction fan not shown in detail and an indicated brush roller 4. The connection between brush set 1 and filter housing 2 is made via a pivotable connecting element 5 with air guiding channels 6 as connecting piece. The filter housing 2 has a riser with a rigid manual suction tube 21 for auxiliary suction work which is disposed detachably on the filter housing 2.

The brush set 1 is disposed at a distance from the floor by means of two rear wheels 7 and one front wheel 8.

The front wheel 8 is disposed height-adjustably for setting a working height of the brush roller 4. The height adjustment of the wheel 8 is made by means of a pushbutton 9 with a compression spring 10 for actuation, which is disposed on the upper side in the edge region of the housing 11 of the brush set 1. The pushbutton 9 in this case acts via an actuating element 12 in the form of a leaf spring with a pin on a rotatable adjusting wheel 13 as detents 14 via corresponding ribs 15. In this case, the wheel 8 is adjusted in its height according to the requirements by means of a connected lever 16 with an adjustable adjusting axis 17. As a result of switching over, the wheel 8 is also lowered again in its height position.

For actuation of the pushbutton 9 via the manual suction tube 6 it is provided that the control surface has a receptacle for corresponding receipt of an edge region of the manual suction tube 6. The receptacle is here, for example, configured as a recess in the form of a gap 18 for the edge region of the manual suction tube 6.

The adjusting wheel 13 is connected via a sprocket 22 to a rotating element 19 for position display, which displays a set height adjustment of the wheel 8 via a viewing window 20 in the brush set 1.

Disclosed is a floor care appliance having a height-adjustable brush set, the pushbutton of which can be actuated for height adjustment by means of a manual suction tube of the floor care appliance, where the pushbutton has a receptacle for receiving an edge region of a manual suction tube and/or for foot actuation.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A floor care appliance in the form of a brush vacuum cleaner comprising:

a brush set facing the floor with a driven brush roller, an electric suction fan, a filter housing connected to the brush set by means of a pivotable connecting element, the electric suction fan being configured to guide dirt-laden air via a riser into an upper region of the filter housing which with a rigid manual suction tube for auxiliary suction work, is disposed detachably on the filter housing, the brush set having wheels, of which at least one is arranged height-adjustably for adjustment of the brush roller with respect to the floor for adaptation of the brush roller to present work conditions, the height-adjustable wheel in the brush set being coupled via a pushbutton in the upper housing region of the brush set onto a multistage switchable detent of a switching over mechanism for height adjustment of the wheel via an adjustable adjusting axis, the detachable manual suction tube of the filter housing configured as an actuating element of a control surface of the pushbutton on the brush set, the control surface having a receptacle for receipt of an edge region of the manual suction tube, the receptacle having a shape corresponding to a shape of the edge region of the manual suction tube.

2. The floor care appliance according to claim 1, wherein the control surface of the pushbutton has a gap as the receptacle for the receipt of the edge region of the manual suction tube.

3. The floor care appliance according to claim 1, wherein the control surface of the pushbutton has an elevation as the receptacle for the receipt of the edge region of the manual suction tube.

4. The floor care appliance according to claim 1, wherein the control surface of the pushbutton has an actuating section for foot actuation.

5. The floor care appliance according to claim 1, wherein the pushbutton is disposed in an edge region of the housing of the brush set.

6. The floor care appliance according to claim 1, wherein the multistage switchable detent is connected to a rotating element for position display, the rotating element configured to be displayed via a viewing window in the brush set as set height adjustment of the wheel.

* * * * *